US011982093B2

(12) United States Patent
Cipriani

(10) Patent No.: US 11,982,093 B2
(45) Date of Patent: May 14, 2024

(54) LEVELING SHIM WITH FLEXIBLE COUPLING MEANS

(71) Applicant: DAKOTA GROUP s.a.s. di Zeno Cipriani & C., Affi (IT)

(72) Inventor: Zeno Cipriani, Belluno (IT)

(73) Assignee: DAKOTA GROUP S.A.S DI ZENO CIPRIANI & C., Affi (IT)

( * ) Notice: Subject to any disclaimer, the term of this patent is extended or adjusted under 35 U.S.C. 154(b) by 491 days.

(21) Appl. No.: 17/285,530

(22) PCT Filed: Sep. 30, 2019

(86) PCT No.: PCT/EP2019/076379

§ 371 (c)(1),
(2) Date: Apr. 15, 2021

(87) PCT Pub. No.: WO2020/078699

PCT Pub. Date: Apr. 23, 2020

(65) Prior Publication Data

US 2021/0388626 A1 Dec. 16, 2021

(30) Foreign Application Priority Data

Oct. 19, 2018 (IT) ..... 102018000009593

(51) Int. Cl.
*E04F 21/18* (2006.01)
*E04F 13/08* (2006.01)

(52) U.S. Cl.
CPC ..... *E04F 21/1877* (2013.01); *E04F 13/0832* (2013.01)

(58) Field of Classification Search
CPC ..... E04F 21/1877; E04F 13/0832; E04F 2015/02061; E04F 2015/02105; E04F 15/02044
See application file for complete search history.

(56) References Cited

U.S. PATENT DOCUMENTS

| | | | | |
|---|---|---|---|---|
| 6,625,951 | B1 * | 9/2003 | McCarthy | E04F 21/0092 52/749.11 |
| 10,196,827 | B2 * | 2/2019 | Cipriani | E04F 15/02405 |
| D875,504 | S * | 2/2020 | Schlüter | D8/354 |
| 11,560,724 | B2 * | 1/2023 | Mendiluza | E04F 21/22 |
| 2011/0289872 | A1 * | 12/2011 | Hiscock | E04F 13/083 52/745.1 |
| 2012/0227214 | A1 * | 9/2012 | Hiscock | E04F 13/0837 29/525 |
| 2014/0366461 | A1 * | 12/2014 | Busby | E04F 15/02183 52/126.6 |
| 2017/0298638 | A1 * | 10/2017 | Bosman | E04F 15/02194 |
| 2021/0032884 | A1 * | 2/2021 | Mendiluza | E04F 21/22 |
| 2021/0388626 | A1 * | 12/2021 | Cipriani | E04F 15/02044 |

FOREIGN PATENT DOCUMENTS

WO WO-2020225587 A1 * 11/2020

OTHER PUBLICATIONS

International Search Report.

* cited by examiner

*Primary Examiner* — Yaritza Guadalupe-McCall
(74) *Attorney, Agent, or Firm* — Jacobson Holman PLLC

(57) ABSTRACT

A leveling shim (1) for building is described, comprising a plastic plate (2), coupling means and through holes. The coupling means comprise flexible coupling means (5) able to be housed in at least one cavity (6) of the plate (2), and at least one coupling through hole (4).

8 Claims, 4 Drawing Sheets

LEVELING SHIM WITH FLEXIBLE COUPLING MEANS

BACKGROUND OF THE INVENTION

The present invention relates to a leveling shim with flexible coupling means.

In the building sector, in particular in the making of coverings or floorings raised by means of variable-height feet, the use of wedges and shims, able to compensate for imperfections in the planarity of a base on which said feet rest, is known.

The need to make coverings or floorings perfectly flat for aesthetic and functional reasons obliges the manufacturers to take into account even minimal irregularities of a few millimeters.

Leveling shims are known, consisting of a plastic plate of a few millimeters, for example 2 mm, with lightening through holes and fastening screw holes.

Said leveling shims generally have a regular shape, for example with a rectangular plan, and may be overlapped so as to obtain the overall thickness desired by stacking one or more leveling shims.

Each leveling shim provides coupling means able to maintain an underlying leveling shim associated with an overlying leveling shim.

Said coupling means consist of coupling protrusions which project laterally from the outer edge of each leveling shim.

Each protrusion comprises a pin which protrudes from a base which provides a lower cavity complementary to said pin.

Usually, a leveling shim comprises four coupling protrusions.

The stacking of two leveling shims involves the coupling of the pins of the coupling protrusions of the underlying leveling shim with the cavities of the coupling protrusions of the overlying leveling shim.

Obviously, it is possible to stack further leveling shims with the same coupling system, thus increasing the overall thickness of a leveling assembly formed by a plurality of said stacked leveling shims.

Disadvantageously, said coupling means increase the lateral dimension of the single leveling shim and, in general, of the leveling assembly.

In case a single leveling shim is used and/or fastening screws are used, it is possible to manually remove said protrusions. However, it is clear that said manual operation is uncomfortable, involves a waste of time and does not ensure a perfect parallelism of the outer edges of the stacked leveling shims.

SUMMARY OF THE INVENTION

It is the object of the present invention to provide a leveling shim for building which may be superimposed on a similar leveling shim, which provides coupling means which do not modify the overall dimension of the leveling shim.

It is a further object of the present invention that said coupling means are easy to make and that they ensure the tightness of the coupling.

It is also a further object of the present invention that said leveling shim is made of plastic, light and easy to couple to the similar leveling shim, forming a leveling assembly which is compact, stable and modifiable if necessary.

According to the invention the above said and further objects are achieved with a leveling shim for building, comprising a plastic plate, coupling means and through holes, characterized in that it comprises flexible coupling means able to be housed in at least one cavity of the plate, and at least one coupling through hole.

Advantageously, the flexible coupling means do not increase the overall height of a leveling assembly formed by a plurality of leveling shims, i.e. they disappear into the cavities and into the coupling through holes.

The coupling of two leveling shims is easy, immediate and, above all, it defines a leveling assembly the dimension of which is given by the sum of the overall dimension of the plates of the two leveling shims.

The flexible coupling means also adapt to the application of a leveling shim or of a leveling assembly to a base which, for example, is wedge-shaped.

DESCRIPTION OF THE DRAWINGS

These and other features of the present invention will become more apparent from the following detailed description of a practical embodiment thereof, shown, but not by way of limitation, in the accompanying drawings, in which.

DETAILED DESCRIPTION OF THE INVENTION

Figure 1:
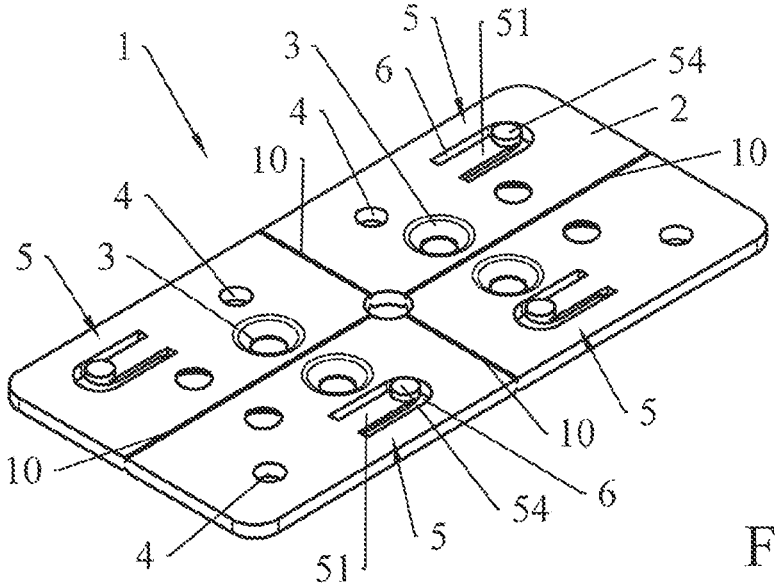
FIG. 1 shows a perspective view of a leveling shim according to the present invention.

A leveling shim 1 (FIGS. 1-5) comprises a plastic plate 2 having a rectangular-shaped plan view with rounded corners and a height of a few millimeters, for example of 2 mm.

The leveling shim 1 provides a plurality of fastening through holes 3 and coupling means comprising a plurality of coupling through holes 4 and a plurality of flexible coupling means 5.

Figure 9:
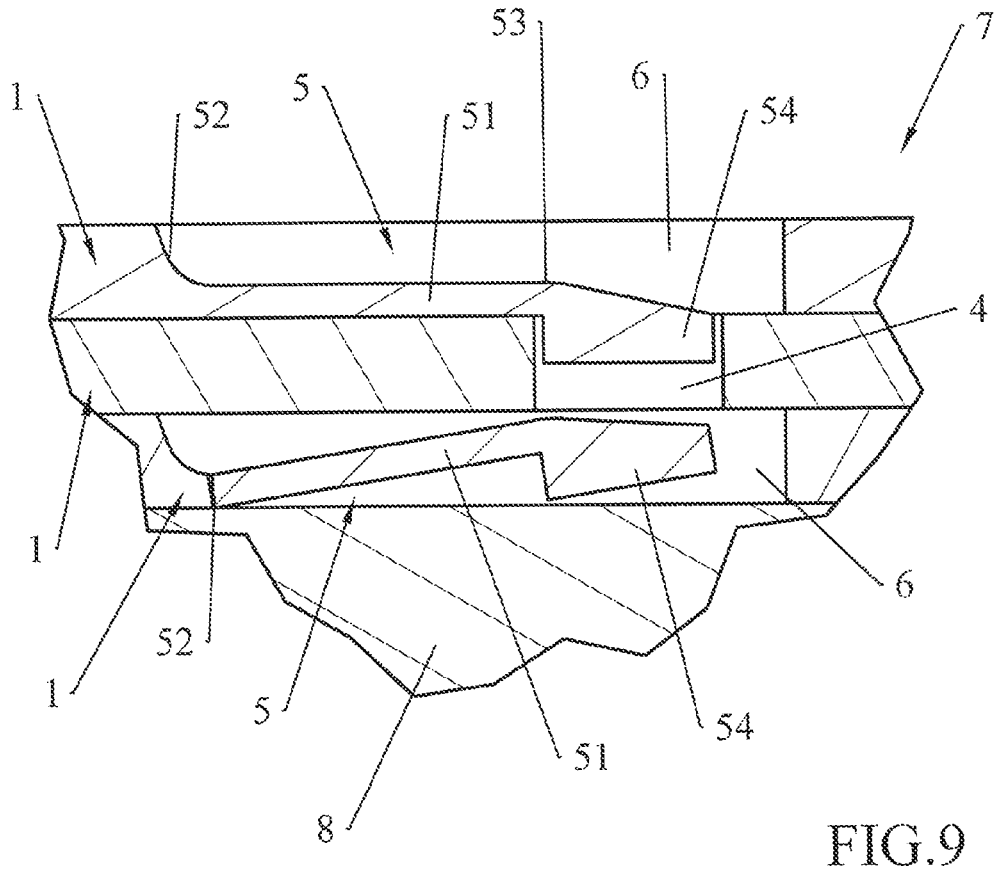
FIG. 9 shows an enlarged view of the circle E of FIG. 8.

The flexible coupling means 5 comprise a flexible arm 51 comprising a first end 52 constrained to the plate 2 and a second end 53 which is free (FIG. 9).

Said second end 53 provides a coupling pin 54.

The flexible arm 51 is able to bend into through cavities 6 of the plate 2.

The fastening through holes 3 are preferably flared and are able to interact with screws.

Figure 6:
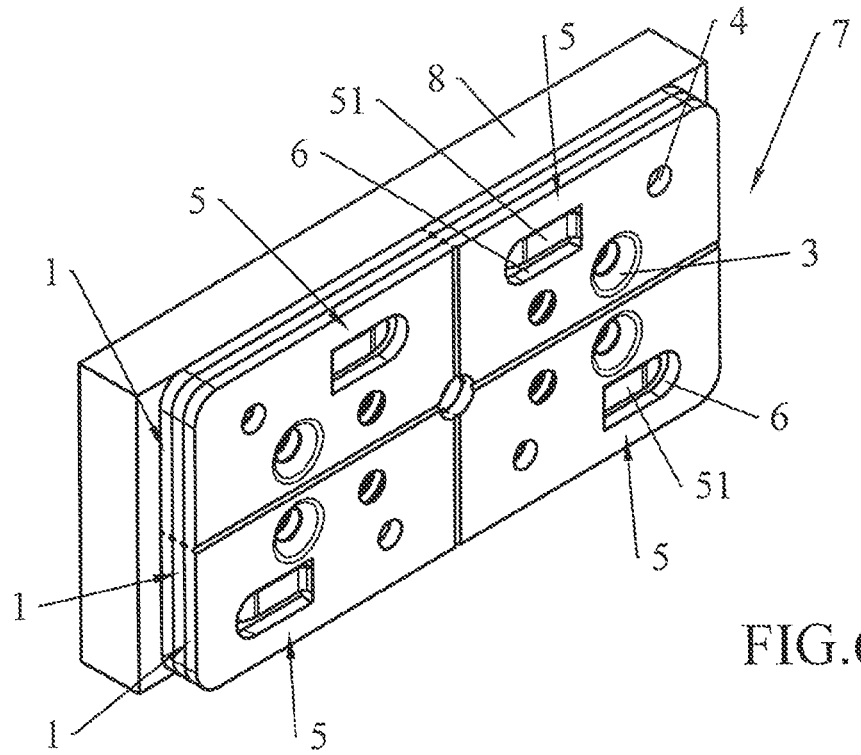
FIG. 6 shows a perspective view of a leveling assembly applied to a base.
Figure 7:
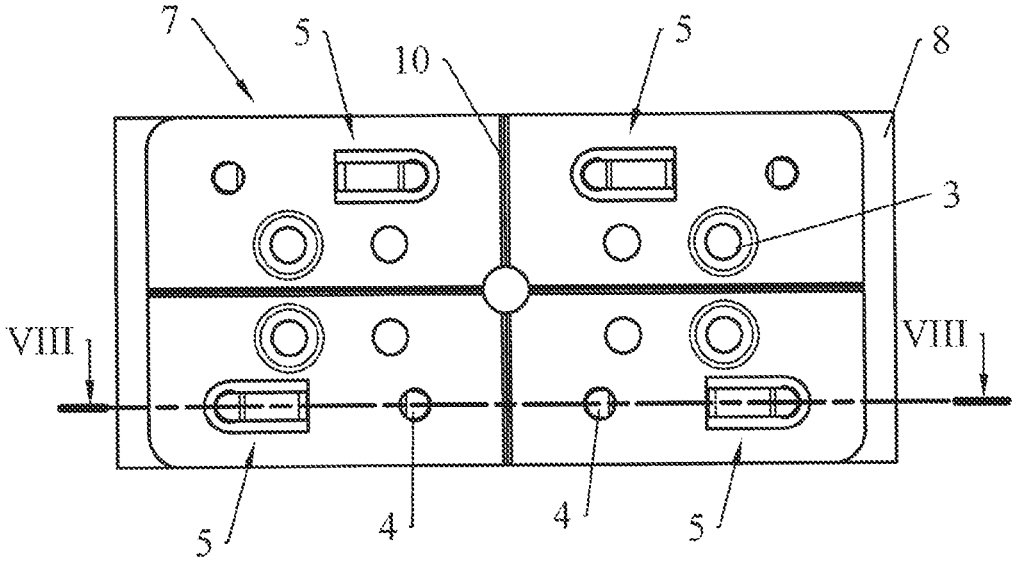
FIG. 7 shows a top plan view of the leveling assembly applied to the base.

FIG. 6 shows a leveling assembly 7 mounted on a base 8 and formed by three stacked leveling shims 1.

Operatively, the coupling of two leveling shims 1 occurs by superimposition, so that the coupling pins 54 of at least one leveling shim 1 are coupled, by interference, to the coupling through holes 4 of another leveling shim 1.

Figure 3:
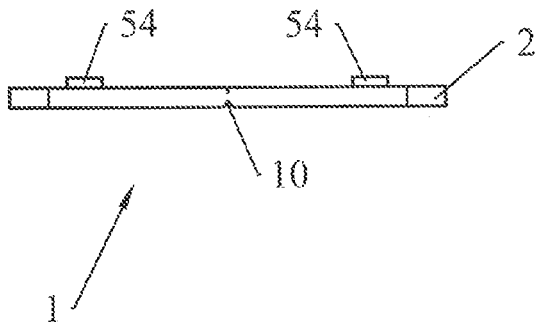
FIG. 3 shows a first side view of the leveling shim, from the right or the left of FIG. 2 in the plane of the drawing.
Figure 4:
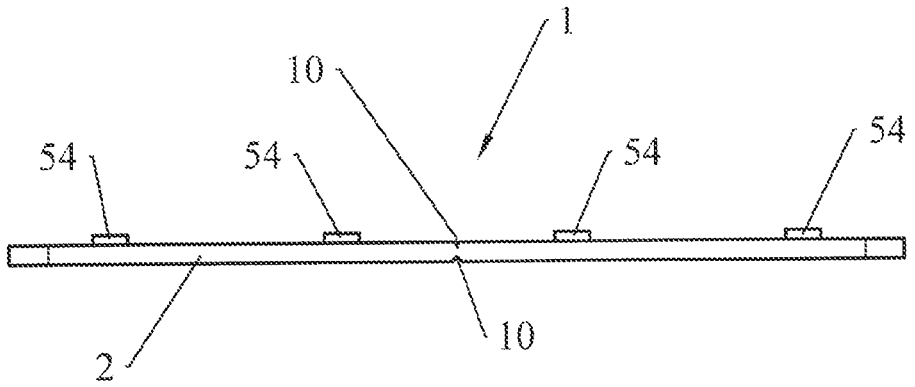
FIG. 4 shows a second side view of the leveling shim, from the top or the bottom of FIG. 2 in the plane of the drawing.
Figure 5:
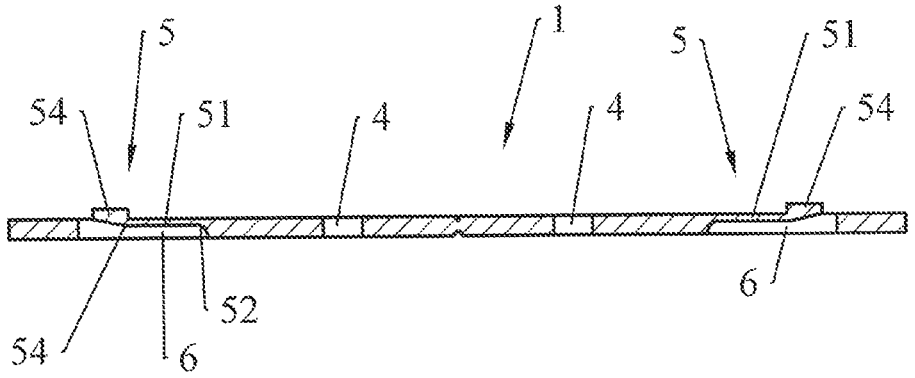
FIG. 5 shows a sectional view according to the line V-V of FIG. 2.

FIGS. 3, 4 show the coupling pins 54 of a single leveling shim 1 which protrude with respect to the height of the plate 2.

In case of coupling with another leveling shim 1, the coupling pin 54 remains completely inside the coupling through hole 4 of the overlying leveling shim 1 (FIG. 9).

Figure 8:
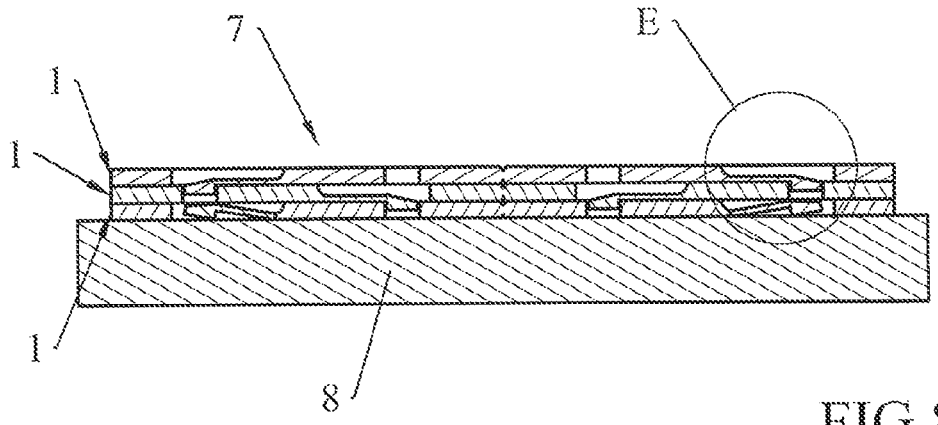
FIG. 8 shows a sectional view according to the line VIII-VIII of FIG. 7.

In FIG. 8 the leveling assembly 7 is fastened to the base 8 by means of screws.

The base 8 may be wedge-shaped.

The leveling shim 1 in contact with the base 8 (FIG. 9) shows the flexible arm 51 bent so that the coupling pin 54 is entirely contained in the through cavity 6 thereof.

Advantageously, the flexible coupling means 5 do not increase the overall height of the leveling assembly 7, i.e. they disappear into the through cavities 6 and into the coupling through holes 4 in case of coupling.

Figure 2:
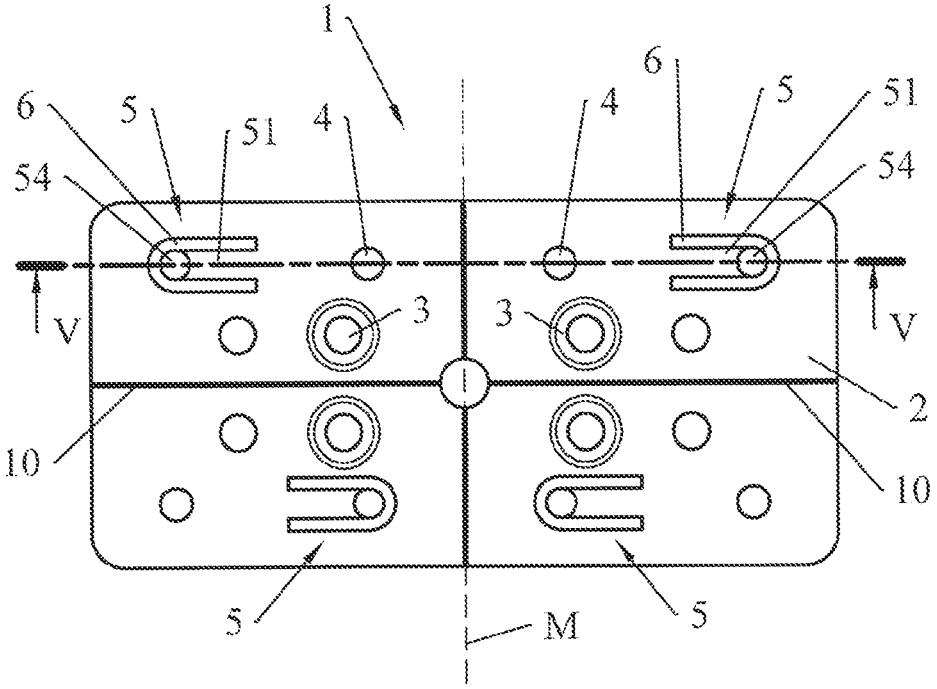
FIG. 2 shows a top plan view of the leveling shim.

In case two leveling shims 1 are coupled to the coupling pins 54 protruding towards each other, each coupling pin 54 is coupled to a respective coupling through hole 4 since the arrangement of the coupling through holes 4 and of the flexible coupling means 5 is specular with respect to a median line M shown in FIG. 2.

The base 8 may provide coupling holes able to couple to the coupling pins 54 of a leveling shim 1, thus making the use of screws which, in general, are not necessary in making the leveling assembly 7, unnecessary.

Advantageously, the coupling of two leveling shims 1 is easy, immediate and, above all, it defines a leveling assembly 7 the dimension of which is given by the sum of the overall dimension of the plates 2 of the two leveling shims 1.

The flexible coupling means 5 do not increase the dimension of the leveling assembly 7 and also adapt to the application of the leveling assembly 7 to a base 8.

The cavities 6 further lighten the leveling shim 1 giving full housing to the flexible coupling means 5.

The leveling shim 1 object of the present invention may also be used in sectors other than building, for example, to interrupt the unpleasant rocking of tables, chairs, furniture, sofas, armchairs and other similar products which rest on a surface which often is non-regular.

Preferably, the leveling shim 1 is provided with median grooves 10 (FIGS. 1 and 2) able to facilitate fragmentation in smaller portions comprising flexible coupling means 5, at least one coupling through hole 4, and preferably at least one fastening through hole 3.

The invention claimed is:

1. Leveling shim for building, consisting of a single plastic plate provided with, coupling means and through holes, wherein the single plastic plate contains a flexible coupling means able to be housed in at least one cavity in the single plastic plate, and in least one coupling through hole.

2. The leveling shim according to claim 1, wherein the flexible coupling means comprise a flexible arm which has a first end which is part of the single plastic plate and a second end which is free and has a coupling pin, the flexible arm being able to enter into the at least one cavity of the single plastic plate.

3. The leveling shim according to claim 1, wherein the leveling shim comprises a plurality of the coupling through holes and a plurality of the flexible coupling means.

4. The leveling shim according to claim 3, wherein the arrangement of the coupling through holes and of the flexible coupling means is specular with respect to a median line.

5. The leveling shim according to claim 3, wherein the leveling shim has median grooves which facilitate fragmentation in smaller portions comprising the flexible coupling means and the at least one coupling through hole.

6. The leveling shim according to claim 1, wherein in a plan view the single plastic plate has a rectangular shape with rounded corners.

7. A leveling assembly for building which comprises at least two stacked leveling shims according to claim 1.

8. The leveling assembly according to claim 7, wherein the at least one coupling pin of the at least one leveling shim is coupled by interference with the at least one coupling through hole of another leveling shim.

* * * * *